United States Patent [19]

Pensa et al.

[11] 4,032,992

[45] July 5, 1977

[54] CONTROLLING DEGREE OF REACTION BY CONTROLLING HEAT INPUT IN CELLULOSE TEXTILE-REACTANT SYSTEMS

[75] Inventors: Ildo Emil Pensa, Palisades Park; Robert Otto Rau, Franklin Lakes, both of N.J.

[73] Assignee: J. P. Stevens & Co., Inc., New York, N.Y.

[22] Filed: Oct. 17, 1969

[21] Appl. No.: 867,411

Related U.S. Application Data

[63] Continuation-in-part of Ser. No. 542,119, April 12, 1966, abandoned, which is a continuation of Ser. No. 402,626, Oct. 8, 1964, abandoned, which is a continuation-in-part of Ser. No. 292,727, June 3, 1963, abandoned.

[52] U.S. Cl. ..... 2/243 R; 8/73; 8/115.7; 8/116 P; 8/120; 8/182; 8/183; 8/184; 8/185; 8/186; 8/187; 8/DIG. 2; 38/144

[51] Int. Cl.[2] ..... D06M 13/28; D06M 15/54; D06M 15/58; D06M 15/64; D06M 15/72

[58] Field of Search ..... 8/116.3, 116.4, 120, 8/116 P, 182–187, DIG. 2; 38/144; 2/243, 243 R; 117/139.4

[56] References Cited

UNITED STATES PATENTS

| | | | |
|---|---|---|---|
| 2,119,150 | 5/1938 | Bowen | 8/116.4 |
| 2,957,746 | 10/1960 | Buck et al. | 8/182 |
| 3,138,802 | 6/1964 | Getchell | 8/116.3 X |
| 3,658,458 | 4/1972 | Gale | 8/116.3 |

FOREIGN PATENTS OR APPLICATIONS

| | | | |
|---|---|---|---|
| 741,655 | 12/1955 | United Kingdom | 8/116.3 |

OTHER PUBLICATIONS

Reid et al., Textile Research Journal, 28, 242–251, (1958).

O'Brien et al., Textile Research Journal, 31, 276–281, (1961).

Dundon, Textile Research Journal, 34, 340–346, (1964).

*Primary Examiner*—J.C. Cannon

*Attorney, Agent, or Firm*—Kenyon & Kenyon, Reilly, Carr & Chapin

[57] ABSTRACT

The method of treating a textile fabric comprising cellulosic fibers to produce a modified fabric intermediate from which permanently shaped wearing apparel having an improved dry crease recovery can be made, comprising the steps of: (1) impregnating the material with a cellulose cross-linking reagent selected from the groups consisting of: (a) reaction products of formaldehyde with carboxamides wherein said reaction products contain 2 or 3 N-methylol groups and methyl ethers thereof; (b) compounds having the following generic formula:

$$R_1OCH_2CH_2SO_2\ (QSO_2)_n\ CH_2CH_2OR_2$$

where $R_1$ and $R_2$ are selected from the group consisting of hydrogen and an alkyl radical of up to five carbon atoms; Q is a divalent organic radical selected from the group consisting of aliphatic radicals containing at least three carbon atoms, aromatic radicals and aklylaromatic radicals; and *n* is 0 or 1, and said reaction conditions include the presence of an alkaline catalyst; (c) compounds have the following generic formula:

$$R_1O-\underset{\underset{R_3}{|}}{CH}-\underset{\underset{R_2}{|}}{CH}-W(QW)_n\underset{\underset{R_2}{|}}{CH}-\underset{\underset{R_3}{|}}{CH}-OR_1$$

where $R_1$, $R_2$, and $R_3$ are selected from the group consisting of hydrogen and alkyl radicals having up to five carbon atoms; Q is a divalent organic radical; W is an electronegative activating group such as —CO—, —CONH, and the like; and *n* has a value of 0 or 1; and (d) compounds having 2 or 3 N-hydroxypropyl groups and methyl ethers thereof; (2) heating the impregnated fabric in an atmosphere in which the relative humidity is less than 100% in the presence of a catalyst to a temperature for a time sufficient to chemically bond the cross-linking reagent to the cellulosic fibers, thereby producing the modified fabric intermediate in which the reacted cross-linking reagent is insolubilized to the extent that the reacted reagent would not be removed by washing the fabric, the modified fabric intermediate having a dry crease recovery angle which is increased by at least 10% by subsequently heating the fabric.

20 Claims, No Drawings

CONTROLLING DEGREE OF REACTION BY CONTROLLING HEAT INPUT IN CELLULOSE TEXTILE-REACTANT SYSTEMS

This application is a continuation-in-part of our copending application, Ser. No. 542,119, filed Apr. 12, 1966, and now abandoned, which in turn is a continuation application of application Ser. No. 402,626 filed Oct. 8, 1964, and now abandoned, which in turn was a continuation-in-part of our application Ser. No. 292,727 filed June 3, 1963, and now abandoned.

The present invention relates to a chemical process for producing a modified textile fabric material having desirable latent properties which permit the modified material to be shaped or fabricated and then further processed to impart a permanent set; and the invention also relates to such modified textile materials. The invention further relates to a process for producing a textile material permanently set in a predetermined configuration which has an improved dry crease recovery and which process is characterized by the interposition of a shaping or fabrication step between the chemical processing steps.

It is generally known that textile yarns and fabrics which contain at least a proportion of cellulosic fibers can be set in a desired shape or configuration by treating the textile material with a cross-linking reagent after the textile material has been shaped. The term "cross-linking reagent" as used above is intended to denote a reagent which can be used to cross-link the fibers or molecules of which the textile material is composed. The cross-linking reagents known in the prior art are believed to provide the desired result by having one reactive site attach to one cellulose chain, and another reactive site of the same molecule attach to a second cellulose chain. By presently accepted theory, such cross-linking of the cellulose chains imparts crease-resistance and permanent set to textile materials. It is believed that the level of crease recovery and permanent set is proportional to the extent of the cross-linking which takes place. Typical cross-linking reagents used in the prior art for these purposes are the melamine formaldehyde resins, urea formaldehyde resins and the like.

There have been suggestions in the prior art that textile materials may be permanently set in a desired configuration by first impregnating the textile material, such as a fabric, with the cross-linking reagent. The impregnated fabric is then partially dried to remove excess moisture, but the extent of applied heat is controlled to prevent complete drying and premature reaction of the cross-linking reagent with the cellulose polymers. The dried fabric is then shaped, for example by introducing pleats. The final step of this prior art process is to expose the pleated fabric to an elevated temperature for a sufficient time to react the cross-linking material with the cellulose polymers. This last step is often referred to as curing. A typical example of this type of process is described in U.S. Pat. No. 2,769,584.

The above described prior art method has several disadvantages. First, unless the impregnated cross-linking reagent is possessed of a very long shelf life, the cross-linking reagent may cure prematurely. In other words, a relatively long period of time may elapse between the impregnation of the fabric and the subsequent shaping and curing steps. If the impregnated cross-linking reagent is not stable, it will tend to react during the storage period. Once cross-linking or curing has taken place, the application of heat in the subsequent curing step will be of no avail and the fabric will retain the shape it assumed during the period of storage.

Another disadvantage of the aforementioned prior art process is that the cross-linking reagent in the fabric remains in soluble form and is readily removed by a simple washing step. Accordingly, the fabric cannot be exposed to any type of wet treatment after impregnation with the cross-linking reagent, and many of the commonly employed processing steps must thus be avoided or modified to prevent removal of the soluble reagent from the impregnated textile material.

Accordingly, it is an object of the present invention to provide a method for imparting crease-retention and especially dry crease recovery, and permanent set to a cellulose textile material which avoids the disadvantages of the prior art methods.

It is a further object of the present invention to provide a method for producing a modified textile material having desirable latent properties which permit the modified material to be shaped or otherwise fabricated and then further processed to impart a permanent set.

Another object of the present invention is to provide a method for producing a modified cellulose textile material which may be permanently set in a predetermined configuration, such method being characterized by the interposition of a shaping or fabrication step between chemical processing steps.

The present invention is predicated on the discovery that a cellulose textile material and a cross-linking reagent may be brought to a condition intermediate between the extremes of mere physical contact and full cross-linking. The foregoing condition is attained by impregnating a cellulose textile material with a cross-linking reagent, and heating the impregnated material in a drying atmosphere having carefully controlled conditions of temperature and time so that the cross-linking reagent is chemically bound to the textile material without substantial cross-linking. A drying atmosphere is one in which the relative humidity is less than 100%.

The thus modified textile material is then shaped or otherwise fabricated, for example, to form a garment containing pleats and/or creases. The fabricated textile article is then exposed to elevated temperatures in the presence of a suitable catalyst for a period of time sufficient to cause the crosslinking reagent to fully react, or cure, thereby imparting a permanent set. The textile material after curing exhibits crease-recovery values which are comparable to those of textile materials which are "cross-linked" in the conventional prior art manner. Furthermore, dry crease recovery is improved when the intermediate reaction is carried out in a drying atmosphere.

Exemplary of the present invention is a process for modifying a fabric made from yarns of cellulose fibers, fabricating a garment such as a skirt from the modified fabric including introduction of pleats and creases, and subsequently treating the skirt to set the skirt in the desired configuration. The first step in such a process involves impregnating the fabric with a cross-linking reagent and a suitable catalyst. Thus, for example, if the cross-linking reagent is polymethylol urea, an acidic catalyst is used. The impregnated fabric is then exposed under drying conditions to an elevated temperature for a sufficient time to effect reaction of the cross-linking reagent in the fabric, while maintaining the cross-linking reaction at a relatively low level. In other words, sufficient heat energy is applied to cause only incomplete reaction.

The modified fabric may then be washed to remove any unreacted cross-linking reagent and also to remove substantially all of the catalyst.

When it is desired to fabricate an article such as a garment from the modified fabric, the fabric may be treated with an appropriate catalyst, conveniently the same catalyst as was used in the first step. The garment is then fabricated in the conventional manner.

The last step of the process involves heating the garment to an elevated temperature for a sufficient period of time to cure the cross-linking reagent which is present in the fabric. Following such curing, the pleats and creases in the garment will be permanently set, and the areas of the garment which were flat during the curing step will be wrinkle-resistant.

Cross-linking reagents useful for this invention are the well-known acid-catalyzed compounds such as N, N' bis(alkoxy methyl) uron, dimethylol alkyl carbamates, dimethylol urea, dimethylol N-alkyl triazones, dimethylol ethylene urea, substituted derivative of dimethylol ethylene urea, methyl ethers of the above compounds, and other derivatives of bi and tri functional N-methylol compounds. This class of compounds are characterized as being reaction products of formaldehyde with carboxamides wherein said reaction products contain 2 or 3 N-methylol groups and methyl ethers thereof. These cross-linking reagents can be used in the present invention in association with any one of the acid and acid forming catalysts normally used when the reagent is utilized in the conventional manner.

A group of polyfunctional sulfones are particularly well suited for use in the present invention. This group of compounds is represented by the following generic formula:

$$R_1OCH_2CH_2SO_2(QSO_2)_nCH_2CH_2OR_2 \quad (1)$$

wherein $R_1$ and $R_2$ are selected from the group consisting of hydrogen and an alkyl radical of up to five carbon atoms; Q is a divalent organic radical selected from the group consisting of aliphatic radicals containing at least three carbon atoms, aromatic radicals and alkylaromatic radicals; and $n$ is 0 or 1.

Specific compounds within generic formula (1) above are:

$$HOCH_2CH_2SO_2CH_2CH_2OH \quad (2)$$
$$CH_3OCH_2CH_2SO_2(CH_2)_4SO_2CH_2CH_2OCH_3 \quad (3)$$
$$HOCH_2CH_2SO_2(CH_2)_2O(CH_2)_2SO_2CH_2CH_2OH \quad (4)$$

Any one of the sulfone compounds of the type shown by formula (1) can be used in accordance with this textile material invention. These sulfone cross-linking reagents are reacted with the cellulose textile material under alkaline conditions. It has been determined that reaction of a textile material with one of these sulfone cross-linking reagents should result in a modified material containing at least about 0.2% bound sulfur based on the weight of the cellulose, in order to attain preferred permanent set and crease recovery values after the curing step.

In addition to the above cross-linking reagents, a class of compounds represented by the following generic formula are suitable for use in the process of the present invention:

$$R_1O-\underset{R_3}{\underset{|}{CH}}-\underset{R_2}{\underset{|}{CH}}-W(QW)_nCH-\underset{R_3}{\underset{|}{CH}}-OR_1 \quad (5)$$

where $R_1$, $R_2$, and $R_3$ are selected from the group consisting of hydrogen and alkyl radicals having up to five carbon atoms; Q is a divalent organic radical; W is an electronegative activating group such as —CO—, —CONH, and the like; and $n$ has a value of 0 or 1. Compounds characterized by generic formula (5) are reacted with the cellulose textile materials under alkaline conditions.

The phrase "electronegative activating group" is intended to denote that the group tends to withdraw electrons from conjugated systems, i.e., such groups are electron-attracting. This phenomenon is discussed in detail in Gould, "Mechanism and Structure in Organic Chemistry", Holt, Rinehart, Winston- New York, 1959, Library of Congress Catalog Card No. 59-8696, pp. 217–218.

Another class of cross-linking reagents include compounds having 2 or 3 N-hydroxypropyl groups and their methyl ethers. These include triazines such as 1, 3, 5 tris(methoxy propyl) hexahydro-s-triazine.

If the cellulose textile material to be treated in accordance with the present invention is in the form of a yarn, the processing steps are the same as outlined above. Thus, the yarn is first impregnated with the cross-linking reagent, and the impregnated yarn is heated in a drying atmosphere at an elevated temperature in the presence of the proper catalyst to bond the reagent to the cellulose fibers, while limiting the degree of cross-linking to a minimum. The yarn is then crimped or bulked, or otherwise shaped, and is then heated in order to permanently set the yarn in the desired configuration.

Set forth below are Examples describing the practice of the present invention. The tests for crease recovery and crease retention rating employed in the Examples are standardized testing methods. The crease recovery values were determined by:

a. Test Method ASTM-D-1295-60T;
b. Laundering Procedure: AATCC88-1961T Test III

The crease retention ratings were determined by:

(a) Test Method: AATCC Committee RA-61, Report Am. D. Rep. Dec. 25, 1961, pp. 1017-1019.
b. Laundering Procedure: AATCC88-1961T Test IIIC2.

EXAMPLE I

Four aqueous solutions of bis(beta hydroxyethyl) sulfone (BHES) were prepared containing: Solution A — 12.3% of a 65% aqueous solution of BHES and 5.2% of anhydrous potassium bicarbonate; Solution B — 15.4% of 65% aqueous solution of BHES and 6.5% of anhydrous potassium bicarbonate; Solution C — 18.5% of a 65% aqueous solution of BHES and 7.8% of anhydrous potassium bicarbonate, and Solution D — 23.1% of a 65% aqueous solution of BHES and 9.75% of anhydrous potassium bicarbonate.

Five swatches of a bleached and mercerized 80 × 80 cotton print cloth were impregnated with each of the above solution. The impregnated swatches were passed through squeeze rolls set to give a wet pickup of 100–105%. The samples were then framed to their original dimensions and dried at 180° F. in a forced draft oven to a moisture content of 5–7%. A swatch from each of the above applications was exposed to a dry heat treatment selected from the following systems and carried out in a continuous forced draft oven:

i. Oven temperature 200° F.- exposure time 180 seconds
ii. Oven temperature 225° F.- exposure time 45 seconds
iii. Oven temperature 225° F.- exposure time 60 seconds
iv. Oven temperature 250° F.- exposure time 15 seconds
v. Oven temperature 250° F.- exposure time 30 seconds
vi. Oven temperature 250° F.- exposure time 45 seconds
vii. Oven temperature 325° F.- exposure time 120 seconds The heat treated swacthes were then washed with hot water at 120° F. containing 0.1% detergent, then rinsed with warm and cold water and finally scoured in a 0.05% acetic acid swatches solution. The samples were all framed to their original dimensions and dried in a forced draft oven set at 180° F. to a moisture content of 5–7%. All swatches were cut in half; one half of each of the samples treated with Solution A was re-impregnated with an aqueous solution of 5.2% anhydrous potassium bicarbonate, those treated with Solution B were re-impregnated with an aqueous solution of 6.5% anhydrous potassium bicarbonate, those treated with Solution C were re-impregnated with an aqueous solution of 7.8% anhydrous potassium bicarbonate, and those treated with Solution D were re-impregnated with an aqueous solution of 9.75% anhydrous potassium bicarbonate. All the re-impregnated samples were squeezed to 100% wet pickup, dried and cured in a forced draft oven set at 325° F. for 120 seconds and then washed with hot water at 140° F. containing 0.1% detergent, rinsed in warm and cold water and scoured in a 0.05% acetic acid solution. The washed pieces were again dried in a forced draft oven set at 180° F. to a moisture content of 5–7%. Dry and wet crease recovery angles were measured on all samples and sulfur content determined.

EXAMPLE II

Three aqueous solutions of N,N'-bis (methoxymethyl) uron (BMMU) were prepared containing: Solution A — 8.1% of a 50% aqueous solution of BMMU and 2.7% of a 30% aqueous solution of magnesium chloride; Solution B — 14.0% of a 50% aqueous solution of BMMU and 4.7% of a 30% aqueous solution of magnesium chloride, and Solution C — 20.0% of a 50% aqueous solution of BMMU and 6.7% of a 30% aqueous solution of magnesium chloride as acid catalyst.

Five swatches of a bleached and mercerized 80 × 80 cotton print cloth were impregnated with each of the above solutions. The impregnated swatches were passed through squeeze rolls set to give a wet pickup of 100–105%. The samples were then framed to their original dimensions and dried at 180° F. in a forced draft oven to a moisture content of 5–7%. A swatch from each of the above applications was exposed to a dry heat treatment selected from the following systems and carried out in a continuous forced draft oven:

i. Oven temperature 200° F.- exposure time 40 seconds
ii. Oven temperature 200° F.- exposure time 60 seconds
iii. Oven temperature 200° F.- exposure time 120 seconds
iv. Oven temperature 225° F.- exposure time 60 seconds
v. Oven temperature 225° F.- exposure time 120 seconds
vi. Oven temperature 250° F.- exposure time 40 seconds
vii. Oven temperature 250° F.- exposure time 60 seconds
viii. Oven temperature 275° F.- exposure time 15 seconds
ix. Oven temperature 275° F.- exposure time 30 seconds
x. Oven temperature 340° F.- exposure time 180 seconds The heat treated swatches were then washed with hot water at 120°–140° F. containing 0.1% detergent, then rinsed with warm and cold water and finally scoured in a 0.5% acetic acid solution. The samples were all

| Padding Solution | Heat Treatment | DRY Crease Recovery: Before Catalyst Treatment and Curing | DRY Crease Recovery: After Catalyst Treatment and Curing | Wet Crease Recovery: After Catalyst Treatment and Curing | Sulfur Content: After Catalyst Treatment and Curing |
|---|---|---|---|---|---|
| Sol. A | (i) | 174° | 220° | — | 0.49% |
| | (ii) | 164° | 218° | — | 0.54% |
| | (iii) | 184° | 228° | — | 0.67% |
| | (vi) | 200° | 242° | — | 0.76% |
| | (vii) | 274° | 270° | — | 1.12% |
| Sol. B | (i) | 197° | 240° | — | 0.57% |
| | (iv) | 161° | 210° | 241° | 0.46% |
| | (v) | 199° | 263° | 271° | 0.86% |
| | (vi) | 220° | 268° | 270° | 1.01% |
| | (vii) | 274° | 278° | 280° | 1.30% |
| Sol. C | (i) | 178° | 234° | — | 0.55% |
| | (ii) | 183° | 234° | — | 0.50% |
| | (iii) | 186° | 245° | — | 0.68% |
| | (v) | 200° | 245° | — | 0.95% |
| | (vii) | 270° | — | — | 1.39% |
| Sol. D | (i) | 169° | 247° | 250° | 1.4 % |
| | (ii) | 181° | 243° | 236° | 0.67% |
| | (iii) | 201° | 253° | — | 1.00% |
| | (iv) | 186° | 236° | — | 0.72% |
| | (v) | 258° | 263° | — | 1.66% |

framed at their original dimensions and dried in a forced draft oven set at 180° F. to a moisture content of 5–7%. All swatches were cut in half. One half of each of the samples treated with Solution A, Solution B and Solution C were re-impregnated with an aqueous solution containing 50 parts per liter of a 30% magnesium chloride aqueous solution. All the re-impregnated samples were squeezed between rubber rolls set to give a wet pickup of 100–105%, dried in a forced draft oven and cured in a similar oven set at 340° F. for 180 seconds, then washed with hot water at 140° F. containing 0.1% detergent, rinsed in warm and cold water and scoured in a 0.05% aqueous solution of acetic acid. The washed pieces were dried in a forced draft oven set at 180° F. to a moisture content of 5–7%. Dry crease recovery angles were measured on all samples.

| Padding Solution | Heat Treatment | DRY CREASE RECOVERY ANGLE Before Catalyst Treatment and Curing | After Catalyst Treatment and Curing |
|---|---|---|---|
| Sol. A | (iii) | 149° | 231° |
| | (vi) | 192° | 247° |
| | (vii) | 192° | 252° |
| | (ix) | 201° | 260° |
| | (x) | 260° | |
| Sol. B | (iv) | 188° | 255° |
| | (v) | 202° | 265° |
| | (vi) | 200° | 262° |
| | (viii) | 191° | 265° |
| | (x) | 276° | |
| Sol. C | (i) | 172° | 261° |
| | (ii) | 175° | 262° |
| | (iii) | 196° | 266° |
| | (iv) | 189° | 263° |
| | (x) | 277° | |

EXAMPLE III

Three aqueous solutions of a commercially available monomeric dimethylol ethylene urea (Aerotex Resin EU, manufactured by the American Cyanamid Co.) (50% active ingredients) were prepared containing: Solution A — 8.0% of Aerotex Resin EU and 1.6% of a 30% aqueous solution of magnesium chloride; Solution B — 14.0% of Aerotex Resin EU and 2.8% of a 30% aqueous solution of magnesium chloride, and Solution C — 20.0% of Aerotex Resin EU and 4.0% of a 30% aqueous solution of magnesium chloride as acid catalyst.

Four swatches of a bleached and mercerized 80 × 80 cotton print cloth were impregnated with each of the above solutions. The impregnated swatches were passed through squeeze rolls to give a wet pickup of 100–105%. The samples were then framed to their original dimensions and dried at 180° F. in a forced draft oven to a moisture content of 5–7%. A swatch from each of the above applications was exposed to a dry heat treatment selected from the following systems and carried out in a continuous forced draft oven:

i. Oven temperature 225° F.- exposure time 40 seconds
ii. Oven temperature 225° F.- exposure time 60 seconds
iii. Oven temperature 225° F.- exposure time 120 seconds
iv. Oven temperature 250° F.- exposure time 20 seconds
v. Oven temperature 250° F.- exposure time 60 seconds
vi. Oven temperature 275° F.- exposure time 15 seconds
vii. Oven temperature 275° F.- exposure time 30 seconds The heat treated swatches were then washed with hot water at 120°–140° F. containing 0.1% detergent, then rinsed with warm and cold water and finally scoured in a 0.05% aqueous solution of acetic acid. The samples were all framed at their original dimensions and dried in a forced draft oven set at 180° F. to a moisture content of 5-7%. All swatches were cut in half. One half of each of the samples treated with Solution A, Solution B and Solution C were re-impregnated with an aqueous solution of 30 grams of a 30% aqueous solution of magnesium chloride per liter. All the re-impregnated samples were squeezed between rubber rolls to a wet pickup of 100–105%, dried in a forced draft oven and cured in a similar oven set at 325° F. for 120 seconds, then washed with hot water at 140° F. containing 0.1% detergent, rinsed in warm and cold water and scoured in an 0.05% aqueous solution of acetic acid. The washed pieces were dried in a forced draft oven set at 180° F. to a moisture content of 5–7%. Dry crease recovery angles were measured on all samples.

| Solution | Treatment | DRY CREASE RECOVERY ANGLE Before Catalyst Treatment and Curing | After Catalyst Treatment and Curing |
|---|---|---|---|
| Sol. A | (iv) | 182° | 233° |
| | (v) | 203° | 242° |
| | (vi) | 213° | 256° |
| | (vii) | 199° | 233° |
| Sol. B | (ii) | 178° | 243° |
| | (iii) | 206° | 257° |
| | (iv) | 195° | 248° |
| | (vi) | 214° | 265° |
| Sol. C | (i) | 186° | 236° |
| | (ii) | 186° | 257° |
| | (iii) | 210° | 271° |
| | (iv) | 209° | 264° |

EXAMPLE IV

Three aqueous solutions of dimethylol ethyl carbamate (DMEC) were prepared containing: Solution A — 10.0% of a 50% aqueous solution of DMEC and 10.0% of a 30% aqueous solution of magnesium chloride; Solution B — 18.0% of a 50% aqueous solution of DMEC and 16.6% of a 30% aqueous solution of magnesium chloride and Solution C — 26.0% of 50% aqueous solution of DMEC and 23.3% of a 30% aqueous solution of magnesium chloride.

Six swatches of a bleached and mercerized 80 × 80 cotton print cloth were impregnated with each of the above solutions. The impregnated swatches were passed through squeeze rolls to give a wet pickup of 100–105%. The samples were then framed to their original dimensions and dried at 180° F. in a forced draft oven to a moisture content of 5–7%. A swatch from each of the above applications was exposed to a dry heat treatment selected from the following systems and carried out in a continuous forced draft oven:

i. Oven temperature 225° F.- exposure time 60 seconds
ii. Oven temperature 250° F.- exposure time 20 seconds
iii. Oven temperature 250° F.- exposure time 40 seconds iv. Oven temperature 250° F.- exposure time 60 seconds
v. Oven temperature 250° F.- exposure time 120 seconds
vi. Oven temperature 275° F.- exposure time 15 seconds
vii. Oven temperature 275° F.- exposure time 30 seconds
viii. Oven temperature 275° F.- exposure time 45 seconds
ix. Oven temperature 300° F.- exposure time 15 seconds
x. Oven temperature 325° F.- exposure time 120 seconds The heat treated swatches were then washed with hot water at 120°–140° F. containing 0.1% detergent, then rinsed with warm and cold water, and finally scoured in a 0.05% aqueous solution of acetic acid. The samples were all framed at their original dimensions and dried in a forced draft oven set at 180° F. to a moisture content of 5–7%. All swatches were cut in half. One half of each of the samples treated with Solution A were re-impregnated with a 3.3% aqueous solution of magnesium chloride, those treated with Solution B were re-impregnated with a 5.0% aqueous solution of magnesium chloride and those treated with Solution C were re-impregnated with a 7.0% aqueous solution of magnesium chloride as catalyst. All the re-impregnated samples were squeezed between rubber rolls to a wet pickup of 100–105%, dried in a forced draft oven and cured in a similar oven set at 325° F. for 120 seconds, then washed with hot water at 120°–140° F. containing 0.1% detergent, rinsed in warm and cold water and scoured in a 0.05% aqueous solution of acetic acid. The washed pieces were dried in a forced draft oven set at 180° F. to a moisture content of 5–7%. Dry crease recovery angles were measured on all samples.

| | | DRY CREASE RECOVERY ANGLES | |
|---|---|---|---|
| Padding Solution | Heat Treatment | Before Re-Impregnation and Curing | After Re-Impregnation and Curing |
| Sol. A | (i) | 194° | 237° |
| | (ii) | 178° | 226° |
| | (iii) | 198° | 244° |
| | (iv) | 208° | 252° |
| | (vi) | 192° | 244° |
| | (x) | 277° | 264° |
| Sol. B | (i) | 206° | 251° |
| | (iv) | 219° | 268° |
| | (vi) | 202° | 250° |
| | (vii) | 214° | 268° |
| | (ix) | 211° | 256° |
| | (x) | 268° | 263° |
| Sol. C | (ii) | 170° | 250° |
| | (iv) | 199° | 262° |
| | (v) | 213° | 269° |
| | (vii) | 203° | 255° |
| | (viii) | 217° | 274° |
| | (x) | 260° | 267° |

EXAMPLE V

Five samples (No. 1 through No. 5) of 80 × 80 cotton print cloth fabric were padded with an aqueous solution of 100 gms. of crystalline 1,3,5 tris(methoxy propyl) hexahydro-s-triazine (TMPT) and 30.5 gms. of potassium carbonate per liter. Two other swatches (No. 6 and No. 7) of 80 × 80 cotton print cloth fabric were padded with an aqueous solution of 200 gms. of a 50% aqueous solution of TMPT and 30.05 gms. of potassium carbonate per liter. The wet pickup was 100%. The impregnated fabrics were dried to a moisture content of 6–8% in a forced draft oven set at 160° F. The samples were then heat treated in a continuous forced draft oven as follows:

No. 1 Oven temperature 275° F.- exposure time 20 seconds
No. 2. Oven temperature 275° F.- exposure time 60 seconds
3. Oven temperature 225° F.- exposure time 180 seconds
No. 4. Oven temperature 225° F.- exposure time 240 seconds
No. 5. Oven temperature 325° F.- exposure time 300 seconds
No. 6 Oven temperature 250° F.- exposure time 60 seconds
No. 7 Oven temperature 250° F.- exposure time 120 seconds The heat treated swatches were then washed with hot water at 120°–140° F. containing 0.1% detergent, then rinsed in warm and cold water and scoured finally in a 0.05% acetic acid solution. The samples were all framed to their original dimensions and dried in a forced draft oven set at 160° F. to a moisture content of 4–8%. All swatches were cut in half. One half of each of the samples was re-padded with an aqueous solution of 30.5 gms. of potassium carbonate per liter. The wet pickup was 100%. The impregnated fabrics were dried to a moisture content of 6–8% in a forced draft oven at 160° F. and then cured in a similar oven set at 325° F. for 300 seconds. The swatches were then washed with hot water at 140° F. containing 0.1% detergent, rinsed in warm and cold water and scoured in a 0.05% acetic acid solution. The washed pieces were dried in a forced draft oven to a moisture content of 4–8%. Dry and wet crease recovery angles were measured on all samples.

| | Dry Crease Recovery | | Wet Crease Recovery | |
|---|---|---|---|---|
| Sample No. | Before Catalyst Treatment | After Catalyst Treatment | Before Catalyst Treatment | After Catalyst Treatment |
| 1 | 171 | 215 | 181 | 218 |
| 2 | 180 | 232 | 218 | 235 |
| 3 | 182 | 236 | 192 | 214 |
| 4 | 190 | 238 | 201 | 222 |
| 5 | 257 | — | 217 | — |
| 6 | 162 | 221 | 194 | 209 |
| 7 | 175 | 228 | 191 | 209 |

EXAMPLE VI

Two samples (No. 1 and No. 2) of 80 × 80 cotton print cloth fabric were padded with an aqueous solution of 82 gms. of a conveniently available 85% Tris-1-aziridinyl phosphine oxide (APO) solution in methanol and 10 gms. of a 40% solution of zinc fluoro borate per liter. A third sample (No. 3) of the same fabric was padded with an aqueous solution of 117 gms. of a commercially available 85% APO solution in methanol and 12.5 gms. of a 40% solution of zinc fluoroborate per liter. The wet pickup was 100%. The impregnated fabrics were dried to a moisture content of 6–8% in a forced draft oven set at 160° F. The samples were then heat treated in a continuous forced draft oven as follows:

No. 1 Oven temperature 250° F.- exposure time 40 seconds
No. 2 Oven temperature 275° F.- exposure time 15 seconds No. 3 Oven temperature 250° F.- exposure time 40 seconds The heat treated swatches were then washed with hot water at 140° F. containing 0.1% detergent, then rinsed in warm and cold water and scoured finally in a 0.05% aqueous acetic acid solution. The samples were all framed to their original dimensions and dried in a forced draft oven set at 160° F. to a moisture content of 4–8%. The three swatches were cut in half and No. 1 and No. 2 were re-padded with an aqueous solution of 10 gms. per liter of 40% solution of zinc fluoroborate. No. 3 was re-padded with an aqueous solution of 12.5 gms. per liter of 40% solution of zinc fluoroborate. The wet pickup was 100%. The impregnated fabrics were dried to a moisture content of 6–8% in a forced draft oven at 160° F. and then cured in a similar oven set at 325° F. for 120 seconds. The swatches were then washed with hot water at 140° F. containing 0.1% detergent, rinsed in warm and cold water and scoured in a 0.05% acetic acid solution. The washed pieces were dried in a forced draft oven to a moisture content of 4–8%. Dry crease recovery angles were measured on all samples.

| | DRY CREASE RECOVERY ANGLES | |
|---|---|---|
| Sample No. | Before Catalyst Treatment and Curing | After Catalyst Treatment and Curing |
| 1 | 199° | 237° |
| 2 | 208° | 243° |
| 3 | 230° | 261° |

EXAMPLE VII

Two samples (No. 1 and No. 2) of an 8-oz. cotton twill fabric were impregnated with an aqueous solution of 143 gms. of bis (beta-hydroxyethyl) sulfone (BHES) and 93 gms. of potassium bicarbonate per liter. A third sample (No. 3) of the same fabric was impregnated with an aqueous solution of 114 gms. of BHES and 74 gms. of potassium bicarbonate per liter. The impregnated pieces were squeezed between rubber rolls to give a wet pickup of 78% and dried in a forced draft oven at 170° F. to a moisture content of 6–8%. The samples were then heat treated in a continuous forced draft oven as follows:

No. 1 Oven temperature 250° F.- exposure time 60 seconds

No. 2 Oven temperature 250° F.- exposure time 75 seconds

No. 3 Oven temperature 250° F.- exposure time 60 seconds

The heat treated fabrics were then washed with hot water at 140° F. containing 0.1% detergent, then rinsed in warm and cold water and scoured finally in a 0.05% aqueous solution of acetic acid. Drying was carried out in forced draft oven at 170° F. until the moisture content was 6–8%. Sample No. 1 and No. 2 were then overpadded with an aqueous solution of 46.5 gms. of potassium bicarbonate per liter and Sample No. 3 was overpadded with an aqueous solution of 37 gms. of potassium bicarbonate per liter. The wet pickup was 75%. The impregnated fabrics were dried to a moisture content of 4–10%. The samples were then creased and pressed, and cured in the creased configuration at 325° F. in a forced draft oven for 180 seconds. The following results were obtained:

| | CREASE RECOVERY ANGLES | | | |
|---|---|---|---|---|
| | Before Catalyst Topping and Curing | | After Catalyst Topping and Curing | |
| Sample No. | DRY | WET | DRY | WET |
| 1 | 166° | 242° | 235° | 260° |
| 2 | 177° | 255° | 246° | 261° |
| 3 | 153° | 216° | 212° | 242° |

| | After Catalyst Topping and Curing WASH AND WEAR RATINGS | | | |
|---|---|---|---|---|
| Sample | Tumble Drying | | Line Drying | |
| No. | 1 Ldg. | 5 Ldgs. | 1 Ldg. | 5 Ldgs. |
| 1 | 4.3 | 4.3 | 4.5 | 3.8 |
| 2 | 4.0 | 4.3 | 4.3 | 4.0 |
| 3 | 4.0 | 4.0 | — | 4.0 |

| | After Catalyst Topping, Creasing and Curing CREASE RETENTION RATINGS | | | |
|---|---|---|---|---|
| Sample | Tumble Drying | | Line Drying | |
| No. | 1 Lgd. | 5 Ldgs. | 1 Ldg. | 5 Ldgs. |
| 1 | 4.8 | 4.0 | 4.0 | 4.0 |
| 2 | 4.8 | 4.3 | 4.8 | 4.5 |
| 3 | 4.3 | 4.0 | 4.5 | 4.3 |

EXAMPLE VIII

Sheeting fabrics, dyed in light blue shade, were impregnated with aqueous solutions of N,N'-bis (methoxymethyl) uron (BMMU): Solution A contained 100 gms. of a 50% BMMU aqueous solution and 14 gms. of a 30% zinc nitrate solution; Solution B contained 165 gms. of a 50% BMMU aqueous solution and 22 gms. of a 30% zinc nitrate solution. The application and handling procedures used were as in Example II except that the heat treatment was carried out only at 250° F. for 60 seconds and the afterwashed samples were topped, respectively, with 14 gms. and 22 gms. per liter of a 30% zinc nitrate solution. The dried fabrics were then fed with paper on both faces into a pleating machine of standard construction, currently used in the pleating trade. The blanket and roll temperatures were kept at 275°–325° F. and the machine was set to give 3/4-inch pleats. The pleated fabric-paper rolls were then cured in a forced draft oven for 120 seconds at 340° F. The pleated products had the following properties:

| | CREASE RECOVERY ANGLES | | | |
|---|---|---|---|---|
| | DRY | | WET | |
| Fabric Treated with Sol. A after catalyst overpad and curing | 268° | | 236° | |
| | CREASE RETENTION RATING OF PLEATS | | | |
| | Tumble Druing | | Line Drying | |
| | 1 Ldg. | 5 Ldg. | 1 Ldg. | 5 Ldgs. |
| Fabric Treated with Sol. B after catalyst overpad, pleating and curing | 5.0 | 5.0 | 5.0 | 5.0 |

In all cases the pleat retention ratings, whether line or tumble dried, were excellent.

EXAMPLE IX

Samples of 2.8 oz. bleached and mercerized dress fabric were treated as in EXAMPLE I with Solution C and heat treated as in the schedule ( (i) through (vii) )

given in the same example. After the washing the samples were dyed in a dye bath prepared with 2.0% Superlite Fast Yellow EFC (Direct Dye-Althouse Chemical Co.) and a liquor ratio of 30:1. A piece of untreated fabric was dyed together with the above. After drying, all the samples dyed to almost the same color weight as the untreated fabric dyed under the same conditions with the exception of the sample that had been heat treated at 325° F. for 120 seconds. These fabrics were then impregnated with an aqueous solution of 6.5% anhydrous potassium bicarbonate squeezed between the rubber rolls of a padder and dried at 160° F. to a moisture content of 6–8%. The dried fabric were pleated by standard procedures and cured in a forced draft oven at 330° F. for 120 seconds.

On repeated laundering, all samples, with the exception of the one heat treated at 325° F. for 120 seconds, gave excellent crease and pleat retention ratings.

EXAMPLE X

Two aqueous solutions were prepared containing: Solution A - 95 gms. of bis-(beta hydroxyethyl) sulfone and 62 gms. of potassium bicarbonate per liter, and Solution B - 54.5 gms. of bis-(beta hydroxyethyl) sulfone and 35.4 gms of potassium bicarbonate. Samples of 80 × 80 bleached and mercerized cotton print cloth were impegnated with the above solutions, squeezed between rubber rolls to give a wet pickup of 100–105%. The samples were then processed as in EXAMPLE I, except that the heat treatment was carried out with a Radiant Heat source at 1000° F. and for an exposure period of 4 seconds. Control samples, treated with each of the above solutions, were cured for 120 seconds at 325° F. Dry and wet crease recovery angles were measured on all samples and sulfur content determined.

| Heat Treatment | | RADIANT HEAT | | CURING 120 SEC./325° F. | |
|---|---|---|---|---|---|
| Chemical Applied | | Soluton A | Solution B | Solution A | Solution B |
| Original Crease Recovery Angles: | | | | | |
| (i) Before Catalyst treatment and curing | DRY | 192° | 195° | 265° | 280° |
| | WET | 196° | 161° | 278° | 255° |
| (ii) After Catalyst treatment and curing | DRY | 262°264°— | — | | |
| | WET | 213° | 200° | — | — |
| Crease Recovery after 5 Ldgs.: | | | | | |
| (I) Before Catalyst treatment and curing | DRY | 213° | 209° | 255° | 267° |
| | WET | 220° | 187° | 262° | 251° |
| (ii) After Catalyst treatment and curing | DRY | 244° | 261° | — | — |
| | WET | 253° | 226° | — | — |
| %Sulfur Content | | | | | |
| (i) Before Catalyst treatment and curing | | 1.01% | 0.50% | 1.20% | 0.85% |
| (ii) After Catalyst treatment and curing | | 1.00% | 0.53% | — | — |

EXAMPLE XI

80 × 80 cotton print cloth fabric was impregnated with an aqueous solution of 130 gms. of crystalline 1,3,5 (trismethoxy propyl hexahydro-s-triazine) and 435 gms. of potassium bicarbonate per liter. The wet pickup was 100–105%. The samples were then processed as in EXAMPLE V, except that the heat treatment was carried out with a Radiant Heat source at 1000° F. and for an exposure period of 4 seconds. Dry and wet crease recovery angles were measured on all pieces:

| DRY CREASE RECOVERY ANGLE | | WET CREASE RECOVERY ANGLE | |
|---|---|---|---|
| Before Catalyst Treatment and Curing | After Catalyst Treatment and Curing | Before Catalyst Treatment and Curing | After Catalyst Treatment and Curing |
| 197° | 230° | 204° | 229° |

EXAMPLE XII 2.8 oz. cotton dress fabric was impregnated with an aqueous solution of 90.5 gms. of bis-(beta hydroxyethyl) sulfone and 57.7 gms. of potassium bicarbonate per liter. The impregnated samples were squeezed between rubber rolls to give a wet pickup of 100%. The padded fabric was then dried at 160° F. in a forced draft oven to a moisture content of 5–7%. It was then subjected to a heat treatment carried out with a radiant heat source at 1000° F. and for an exposure time of 4 seconds. After washing and drying, the fabric was impregnated with an aqueous solution of 22.6 gms. per liter of potassium bicarbonate, squeezed between rubber rolls to give a wet pickup of 100% and dried at 160° F. in a forced draft oven to a moisture content of 5–7%. The sample was then hand pleated. The pressed pleated fabric was subjected to a curing cycle of 120 seconds at 325° F. in a forced draft oven. The finished fabric gave crease retention ratings of 4.0–4.5 after laundering and either tumble drying or line drying.

EXAMPLE XIII

An 8-oz. cotton twill was padded with an aqueous solution of 176 gms. N,N'-(bis-methoxymethyl) uron and 47.5 gms. of a 30% aqueous solution of zinc nitrate per liter. The wet pickup was 68–70%. The fabric was then dried to a moisture content of 6–8% in a forced draft oven and cut into three samples. Each of these samples were exposed to one of the following heat treatments, carried out in a conventional textile oven with frame:

i. Oven temperature 250° F.- exposure time 60 seconds
ii. Oven temperature 250° F.- exposure time 90 seconds
iii. Oven temperature 275° F.- exposure time 30 seconds The heat treated samples were then washed with hot water at 120°–140° F. containing 0.1% detergent, then rinsed with warm and cold water and finally scoured in a 0.05% acetic acid solution. They were all framed to their original dimensions and dried in a forced draft oven set at 160° F. to a moisture content of 6–8%. All the pieces were impregnated with an aqueous solution of 24.0 gms. of a 3% aqueous solution of zinc nitrate per liter. The wet pickup was 65%. The dried fabrics were then creased and cured in a forced draft oven at 350° F. for 180 seconds. The finished fabrics had the following properties:

| | CREASE RECOVERY ANGLES | | | | | |
|---|---|---|---|---|---|---|
| Sample | After Heat Treatment | | After Catalyst Topping | | After Curing | |
| No. | DRY | WET | DRY | WET | DRY | WET |
| (1) | 178° | 249° | 188° | 252° | 239° | 265° |
| (ii) | 200° | 253° | 210° | 257° | 246° | 265° |
| (iii) | 177° | 249° | 196° | 256° | 241° | 257° |

| | CREASE RETENTON -1 Laundering (After Creasing and Curing) | |
|---|---|---|
| Sample No. | Tumble Drying | Line Drying |
| (i) | 5.0 | 4.5 |
| (ii) | 4.8 | 4.8 |
| (iii) | 5.0 | 4.8 |

EXAMPLE XIV

A 64-inch width, 46 × 50, 1.84 yds./lb. cotton sports denim was treated as in EXAMPLE I with Solution A and heat treated at 250° F. for an exposure time of 60 seconds. After washing and drying, the fabric was slack mercerized by standard procedures used in the production of filling stretch fabrics. The sports denim fabric was then impregnated with an aqueous solution of 52 gms. bicarbonate per liter, then dried, cured at 325° F. for 120 seconds, washed and dried again. The finished sample showed showed the same stretch characteristics as those of a similar fabric treated by slack mercerization, but without chemical treatment. Moreover, after repeated launderings, the growth in the filling was less than 0.5%.

EXAMPLE XV

A 55% polyester (produced by DuPont under the trademark Dacron) + 45% polynosic (produced by American Viscose under the trademark Avril) blend poplin was dyed in a union black shade (a sulfur dyestuff for the cellulosic part), in a union tan shade (a vat dyestuff was used for the cellulosic part) and in a cross-dye grey/green shade (a vat dyestuff was used for the cellulosic part). In all cases the polyester component was dyed with standard polyester disperse dyestuffs.

Three samples of each of the above dyed fabrics were impregnated with the following aqueous solutions:

Solution A: 140 grams of a 45% aqueous solution of dimethylol ethyl carbamate (DMEC) and 44 grams of a 30% aqueous solution of magnesium chloride per 1000 grams solution.

Solution B: 210 grams of a 45% aqueous solution of DMEC and 66 grams of a 30% aqueous solution of magnesium chloride per 100 grams solution.

The impregnated samples were squeezed between rubber rolls to a wet pickup of 80%, framed to its original dimensions and dried in a forced draft oven. The dried samples from each of the above applications were subjected to heat cycles in a forced draft oven:

Set at a temperature of 250° F. for a period of 90 seconds
Set at a temperature of 275° F. for a period of 45 seconds
Set at a temperature of 275° F. for a period of 60 seconds In all cases the moisture content of the samples after the heat cycle were zero. The exposed samples were then washed and dried in a forced draft oven, after which the samples treated with the Solution A were impregnated with an aqueous solution containing 22 grams of a 30% aqueous solution of magnesium chloride and 10 grams of a 3% polyethylene emulsion per 1000 grams solution. The samples treated with the Solution B were impregnated with an aqueous solution containing 33 grams of a 30% solution of magnesium chloride and 10 grams of a 30% polyethylene emulsion per 1000 grams solution. The impregnated samples were then squeezed between rubber rolls and dried in a forced draft oven.

After drying, the samples were folded along the warp direction, pressed on a commercially available garment press to form a crease and cured in a forced draft oven at 325° F. for 180 seconds.

The pressed and cured swatches were then subjected to ten washing and tumble drying cycles. All samples were rated between 4.5 and 5.0 in both wash and wear and crease retention performance according to AATCC rating standards.

EXAMPLE XVI

The same fabrics described in Example XV were also treated as in the same example except that the applied solutions were prepared as follows:

Solution A: 140 grams of a 45% aqueous solution of dimethylol ethyl carbamate (DMEC) and 20 grams of citric acid solids per 1000 grams solution.

Solution B: 210 grams of a 45% aqueous solution of DMEC and 20 grams of citric acid solids per 1000 grams solution.

The impregnated and dried samples were subjected to heat cycles in a forced draft oven:

Set at a temperature of 275° F. for a period of 90 seconds
Set at a temperature of 275° F. for a period of 75 seconds
Set at a temperature of 275° F. for a period of 60 seconds The exposed samples were then pressed as in Example XV.

The creased and cured samples were tested for wash and wear and crease retention performance after repeated laundering and tumble drying. After twenty washing and drying cycles, the samples were rated between 4.5 and 5.0 for both crease retention and wash and wear.

EXAMPLE XVII

A dimethylol ethyl carbamate (DMEC) solution was prepared by mixing 335 grams of a 45% aqueous DMEC solution into 645 grams of water and 20 grams of citric acid. This mixture was used to impregnate dyed samples of fabrics of the following fiber composition:

1. 55% acrylic (produced by DuPont under the trademark orlon) + 37% rayon - rayon acetate blend
2. 70% rayon + 30% rayon acetate blend
3. 92% rayon +8% rayon acetate blend The impregnated samples were squeezed between rubber rolls to give a wet pickup of 90–95%, framed to their original dimensions and dried in a forced draft oven. The samples were exposed to heating cycle in a forced draft oven set at 275° F. for a period of 45 seconds, for 1, acrylic, and 90 seconds for 2 and 3, rayon and rayon acetate blends, then washed and dried.

The dried swatches were impregnated with a solution containing 60 grams of a 30% aqueous solution of magnesium chloride and 10 grams of a 30% polyethylene emulsion per 1000 grams of solution, squeezed between rubber rolls to give a wet pickup of 85–90%, framed to their original dimensions and dried in a forced draft oven.

After drying, the samples were folded along the warp direction, pressed on a commercially available garment press to form a crease and cured in a forced draft oven at 325° F. for a period of 300 seconds.

The pressed and cured samples were tested for wash and wear and crease retention performance after repeated laundering and tumble drying. After ten washing and drying cycles, the samples rated between 4.5 and 5.0 for both crease retention and wash and wear.

EXAMPLE XVIII

An 8-oz. all-cotton twill was impregnated with a solution containing 190 grams of a 45% aqueous solution of N,N' bis hydroxy methyl dihydroxy imidazolidone (described in U.S. Pat. No. 3,049,446) and 34 grams of a 30% aqueous solution of zinc nitrate per 1000 grams. The impregnated fabric was squeezed between rubber rolls to give a wet pickup of 60% framed to its original dimensions and dried in the forced draft oven. The treated cloth was exposed to a heating cycle in a forced draft oven set at 250° F. for a period of 60 seconds, then washed and dried.

The exposed fabric was then re-impregnated with a solution containing 20 grams of a 30% aqueous solution of zinc nitrate, 10 grams of a 30% polyethylene emulsion and 40 grams of a polyethylene glycol with a molecular weight of approximately 600 per 1000 grams. The impregnated fabric was squeezed between rubber rolls to a wet pickup of 50%, framed and dried in a forced draft oven.

Samples of the treated fabric were folded along the warp direction, pressed in a commercially available garment press to form the crease and cured in a forced draft oven at 325° F. for a period of 300 seconds. Performance data of the treated fabric is given below:

| | Before Creasing | After Creasing and Curing |
|---|---|---|
| Crease Recovery Angle (W+F Dry | 192° | 263° |
| Crease Retention | | |
| after 5 Launderings & Tumble Drying | — | 5.0 |
| after 10 Launderings & Tumble Drying | — | 4.8 |
| Wash and Wear | | |
| after 5 Launderings & Tumble Drying | 2.0 | 5.0 |
| after 10 Launderings & Tumble Drying | 2.0 | 5.0 |

EXAMPLE XIX

Dyed skeins of bleached 100% cotton yarn were impregnated with a solution containing 135 grams of a 45% aqueous solution of dimethylol ethyl carbamate and 43 grams of a 30% aqueous solution of magnesium chloride per 1000 grams. The impregnated skeins were hydroextracted to wet pickup of 100%, then dried in a forced draft oven.

One part of these skeins was then exposed to a heating cycle in a draft oven set at 250° F. for a period of 60 seconds, then washed, hydroextracted and dried.

Both sets of skeins (with and without exposure to the heating cycle) were used to make two fabric samples of an 80 × 80 type print cloth using standard weaving procedures. The fabric woven from the skeins that had not been heat treated was exposed to the same heating cycle as described above, then washed and dried.

The two fabrics were then impregnated with a solution containing 22 grams per 1000 grams of a 30% aqueous solution of magnesium chloride, squeezed between rolls to a wet pickup of 100% and dried in a forced draft oven.

The dried fabrics were then pleated by standard procedures and cured in a forced draft oven at 325° F. for a period of 180 seconds.

The following are test results obtained on the treated fabrics:

| | Fabric woven from yarn that had been exposed to a heating cycle | |
|---|---|---|
| | Before Pleating and Curing | After Pleating and Curing |
| Crease Recovery Angle (W+F) | 186° | 246° |
| Crease Retention | | |
| after 5 Launderings & Tumble Druying | — | 4.8 |
| after 10 Launderings & Tumble Drying | — | 4.8 |
| Retention of Pleat | | |
| after 10 Launderings & Tumble Drying | Good to — | Excellent |
| | Fabric exposed to the heting cycle after being woven | |
| | Before Pleating and Curing | After Pleating and and Curing |
| Crease Recovery Angle (W+F) Dry | 193° | 251° |
| Retention of Crease | | |
| after 5 Launderings & Tumble Drying | — | 4.8 |
| after 10 Launderings & Tumble Drying | — | 4.5 |
| Retention of Pleat | | |
| after 10 Launderings & | Good to | |

-continued

| | | |
|---|---|---|
| Tumble Drying | — | Excellent |

It is evident that subjecting the impregnated textile material to an excess amount of heat during the first step of the process of this invention will result in fully cross-linking the textile material and would impart a permanent set to the material in the normally flat configuration which it assumed during this step. Thus, there would be no possibility of setting the textile material in the desired shape or configuration after manufacturing an article such as a garment from the textile material.

The present invention is predicated on the surprising discovery that careful control of the heat energy applied to the textile material in the first step of the process and maintenance of drying atmospheric conditions during which that step is performed results in an improved, finished article, such as a garment, having a permanent shape imparted to it after the subsequent heating step and also having improved dry crease recovery properties when compared to similar garments which were made under wet or non-drying conditions.

The unexpected results are strongly supported by the results obtained in the treatment of a material which is devoid of cellulose fibers. If the cross-linking reagents shown in the above Examples are applied under the reaction conditions indicated to a polymer which does not contain a significant number of sites, such as for example a 100% polyester material or polyolefin textile material, no insolubilization takes place and the reagent is completely removed when the treated polymer is washed.

The amount of heat energy required to obtain the intermediated product, while avoiding premature curing, is dependent on the structure of the cross-linking reagent and on the catalyst used. In general, the amount of heat energy applied to the dried impregnated textile material should be approximately between 20% and 50% of the amount of heat energy normally required to obtain substantially complete curing of the cross-linking reagent and the textile material.

The amount of heat energy required to obtain the desired result in any particular system comprising the cellulose-containing textile material, the cross-linking reagent and the catalyst can be defined as that which gives an adequate yield of the desired intermediate product as defined without substantial cross-linking. In the case of fabrics, if the increase in crease recovery is taken as a measure of cross-linking, then the heat applied in the first step must be just below the amount causing a substantial increase in fabric crease recovery. Using the dry crease recovery angle as a parameter, the modified textile fabric may be characterized as having a dry crease recovery angle which is increased by at least 10% by subsequently heating the fabric. Thus, as shown in Example I, varying schedules of temperature and time provide a variation in both the dry crease recovery angle before curing, and after curing. Increasing the severity of the reaction increases the dry crease recovery angle of the fabric, finally to a point where no increase is obtained by the curing step. This is readily apparent from a study of the table provided in connection with Example I.

The amount of cross-linking reagent used in the impregnation step of course depends upon the characteristics of the fabric and of the cross-linking reagent, and in addition is dependent on the form of the textile material. In general, it is advantageous to utilize water as a solvent for the cross-linking reagent and the catalyst. In some instances, by reason of solubility problems, it may be necessary to use a combination of solvents.

In the interest of convenience, it is preferable to apply both the cross-linking reagent and the catalyst in a single step. Such impregnation is accomplished in any conventional manner, and, as shown in the examples, padding in the case of fabrics or immersion followed by hydroextraction in the case of yarns, are suitable. In general, the concentration of cross-linking reagent in the solvent should be in the approximate range of 3% to 20% by weight. The wet pick-up of solvent containing the cross-linking reagent may be in the approximate range of 50% to 100%, this giving an amount of cross-linking reagent, based on the weight of the textile material, of approximately 1.5% to 20%.

With respect to those cross-linking reagents described above which are catalyzed under alkaline conditions, the milder alkaline materials such as the alkali metal acetates, carbonates and bicarbonates are preferred catalysts for both steps. In general, amounts of catalyst in the range of from about 0.5% to 5% based on the weight of the cellulose in the textile material is satisfactory. Desirably, a pH between about 8 and 10 is suitable, this parameter not being particularly critical.

With respect to those cross-linking reagents which are catalyzed under acidic conditions, acids and acid-forming salts, such as ammonium and amine salts of mineral acids, cyanic acids, salts of mineral acids with bivalent metals and the like are generally suitable. Amounts of acidic catalysts ranging from 0.5% to 5% based on the weight of cellulose treated is generally satisfactory.

In the first step of the process, where the cross-linking reagent in the presence of a suitable catalyst is made to react with the cellulose, optimum time and temperature are selected as indicated above. Generally, temperatures of about 200° F. to 300° F. and reaction times of between 20 seconds and 5 minutes are suitable, with shorter times being indicated at the higher temperatures. When high temperatures can be conveniently reached however, such as is the case in radient heat equipment, a few seconds of exposure will suffice.

In the Examples set forth above, a drying step has been indicated subsequent to the impregnation of the textile material and prior to the heating step in which the cross-linking reagent is insolubilized in the material. Such drying step is not necessary and the moisture content of the textile material prior to the aforementioned heating step is not critical so long as it is conducted under drying conditions. The drying step, however, is preferred in that it provides for close control of the heating step. In other words, the reproducibility of the process is enhanced by ensuring that the fabric or textile material is always in the same condition at the commencement of the heating step. If so desired, the impregnated fabric containing substantial amounts of water may be introduced into the heating equipment, the water removed by the dry atmosphere therein and the cross-linking reagent insolubilized all in a single step.

Following the first heating step, the textile material may contain unreacted, soluble cross-linking reagent and unspent catalyst. In this condition, the textile material or fabric may be suitably shaped into a garment or otherwise fabricated, and subsequently cured. Optionally, the textile material may be washed to remove the residual catalyst and unreacted cross-linking reagent or it may be stored as such. If washed, it is necessary to reapply the catalyst which is needed for the curing step. Such application of catalyst may be made on the textile material prior to shaping, or on the finished article such as a skirt.

Following shaping or other fabrication of the textile material, the shaped article is subjected to reaction conditions to further react the insolubilized cross-linking reagent, thereby cross-linking the cellulose fibers. The temperatures used in the curing step should preferably be above 200° F. Temperatures in the range of from about 250° F. to 400° F. are preferred since the duration of the curing step is thereby decreased to a practical minimum.

In treating yarns in accordance with the present invention, higher temperatures, of the order of 700° F., may be conveniently employed in the curing step since the residence time in equipment generally used for yarn setting is of relatively short duration.

The source of heat for the first step of the process and the last step, or curing step, is not critical, and any one of the conventional means of heating, such as steaming, pressing or baking, can be employed. Radiant heat, infrared heat and other heat sources can also be employed.

The duration of the curing step is dependent in large measure on the temperature employed. As shown by the Examples, the curing time can vary up to a period of several minutes or more.

As shown in Examples IX, XV and others, a dyeing step may be incorporated in the process of this invention. Such dyeing may be conducted either before the first heating step or subsequent thereto, but prior to the curing step. Textile materials which are cross-linked by the process of this invention are relatively poor in dye receptivity.

It is to be appreciated that the present invention is suitable for use in treating textile materials consisting wholly or in part of cellulose fibers, including cotton, regenerated cellulose, linen, and the like. Although the preceding examples emphasize the application of the present invention to the treatment of fabrics and setting of garments manufactured from them to retain desirable shape pleats or creases, it is to be understood that the present invention is equally applicable to treating yarns, fibers or other textile forms. In addition, the present invention can be used to set garments to retain their shape, to avoid seam puckering in laundering, and to generally improve appearance rating after laundering.

When yarns are treated in accordance with the present invention, the modified yarns can be cured in the desired configuration either before or after fabrication into a fabric.

Modifications of this invention can be made by one skilled in the art without departing from the scope and spirit of this invention.

We claim:

1. The method of producing a permanently shaped textile article from a material comprising cellulosic fibers comprising the steps of:

A. shaping a material into a desired configuration, said material comprising cellulosic fibers and which material has been:

1. impregnated with a cellulose cross-linking reagent selected from the group consisting of:

a. reaction products of formaldehyde with carboxamides wherein said reaction products contain 2 or 3 N-methylol groups and methyl ethers thereof;

compounds having the following generic formula:

$$R_1OCH_2CH_2SO_2(QSO_2)_nCH_2CH_2OR_2$$

wherein $R_1$ and $R_2$ may be the same or different and are selected from the group consisting of hydrogen and an alkyl radical of up to five carbon atoms; Q is a divalent organic radical selected from the group consisting of aliphatic radicals containing at least three carbon atoms, aromatic radicals and alkylaromatic radicals; and, *n* is 0 or 1; and, said reaction conditions include the presence of an alkaline catalyst;

c. compounds selected from the group consisting of 1,3,5 tris (hydroxypropyl) hexahydro-s-triazine and 1,3,5 tris (methoxypropyl) hexahydro-s-triazine and, d. tris-1-aziridinyl phosphine oxide; and, 2. heated in an atmosphere in which the relative humidity is less than 100% and in the presence of a catalyst, to a temperature in the range of between about 200° F. to about 1000° F. for a period of time in the range of between about 5 minutes and about 4 seconds during which time period said cross-linking reagent is chemically bonded to said cellulosic material, said time-temperature relationship being such that in the lower temperature range the time period is in the higher time range and in the higher temperature range the time period in the lower time range and under such heating conditions that the maximum heat energy applied to said impregnated material is that heat energy which allows said material to have a maximum dry crease recovery angle increasable by at least 10% by subsequent heating to cure said material, to thereby produce a modified material intermediate; and B. without further addition of catalysts to said material, heating the shaped material to cure said chemically bonded cross-linking reagent to provide a permanently shaped textile article having at least said increased dry crease recovery angle.

2. The method of claim 1 in which said cellulosic fibers are cotton.

3. The method of claim 1 in which said cross-linking reagent is selected from the group consisting of reaction products of formaldehyde with carboxamides wherein said reaction products contain 2 or 3 N-methylol groups and methyl ethers thereof.

4. The method of claim 1 in which said cross-linking reagent has the following generic formula:

$$R_1OCH_2CH_2SO_2(QSO_2)_nCH_2CH_2OR_2$$

where $R_1$ and $R_2$ are selected from the group consisting of hydrogen and an alkyl radical of up to five carbon atoms; Q is a divalent organic radical selected from the group consisting of aliphatic radicals containing at least three carbon atoms, aromatic radicals and alkylaromatic radicals; and *n* is 0 or 1, and said reaction conditions include the presence of an alkaline catalyst.

5. The method of claim 1 in which said cross-linking reagent is selected from the group consisting of 1,3,5tris (hydroxypropyl) hexahydro-s-triazine and 1,3,5 tris (methoxypropyl) hexahydro-s-triazine.

6. The method of claim 1 in which said cross-linking reagent is bis (beta-hydroxyethyl) sulfone, and said reaction conditions include the presence of an alkaline catalyst.

7. The method of claim 2 in which said cross-linking reagent is bis (hydroxyethyl ethyl sulfonyl) ethyl ether, and said reaction conditions include the presence of an alkaline catalyst.

8. The method of claim 1 in which said cross-linking reagent is N,N'-bis (methoxymethyl) uron, and in which the reaction conditions include an acid-forming catalyst.

9. The method of claim 1 in which the cross-linking reagent is monomeric dimethylol ethylene urea, and in which the reaction conditions include an acid-forming catalyst.

10. The method of claim 1 in which the cross-linking reagent is dimethylol ethyl carbamate, and in which the reaction conditions include an acid-forming catalyst.

11. The method of claim 1 in which the cross-linking reagent is tris-1-aziridinyl phosphine oxide, and in which the reaction conditions include an acid-forming catalyst.

12. The method of claim 1 in which the cross-linking reagent is N,N' bis (hydroxy methyl) dihydroxy imidazolidone, and in which the reaction conditions include an acid-forming catalyst.

13. The method of claim 1 wherein said material is a yarn which has been formed into a fabric subsequent to being impregnated and initially heated and prior to being shaped.

14. The method of claim 1 wherein said material is a yarn.

15. The permanently shaped yarn produced in accordance with the method of claim 14.

16. A permanently shaped textile article produced in accordance with the method of claim 1.

17. The method of producing a permanently shaped wearing garment having an improved dry crease recovery angle from a textile fabric comprising cellulosic fibers comprising the steps of:

1. impregnating a fabric comprising cellulosic fibers with a cellulose cross-linking reagent selected from the group consisting of:
   a. reaction products of formaldehyde with carboxamides wherein said reaction products contain 2 or 3 N-methylol groups and methyl ethers thereof;
   b. compounds having the following generic formula:

$$R_1OCH_2CH_2SO_2(QSO_2)_nCH_2CH_2OR_2$$

wherein $R_1$ and $R_2$ may be the same or different and are selected from the group consisting of hydrogen and an alkyl radical of up to five carbon atoms; Q is a divalent organic radical selected from the group consisting of aliphatic radicals containing at least three carbon atoms, aromatic radicals and alkylaromatic radicals; and, *n* is 0 or 1; and, said reaction conditions include the presence of an alkaline catalyst;
   c. compounds selected from the group consisting of 1,3,5 tris (hydroxypropyl) hexahydro-s-triazine and 1,3,5 tris (methoxypropyl) hexahydro-s-triazine; and,
   d. tris-1-aziridinyl phosphine oxide; and,
2. heating said impregnated fabric in an atmosphere in which the relative humidity is less than 100% and in the presence of a catalyst, to a temperature in the range of between about 200° F. to about 1000° F. for a period of time in the range of between about 5 minutes and about 4 seconds during which time period said cross-linking reagent is chemically bonded to said cellulosic material, said timetemperature relationship being such that in the lower temperature range the time period is in the higher time range and in the higher temperature range the time period is in the lower time range and under such heating conditions that the maximum heat energy applied to said impregnated fabric is that heat energy which allows said fabric to have a maximum dry crease recovery angle increasable by at least 10% by subsequent heating to cure said material, thereby producing a modified fabric intermediate; and without further addition of catalyst to said fabric,
3. shaping the fabric to a desired garment configuration; and,
4. heating the shaped fabric to cure said chemically bonded cross-linking reagent to provide a permanently shaped garment having at least said increased dry crease recovery angle.

18. A permanently shaped garment produced in accordance with the method of claim 17.

19. The method of producing a permanently shaped textile article from a material comprising cellulosic fibers comprising the steps of:

A. shaping a material into a desired configuration, said material comprising cellulosic fibers and which material has been:
   1. impregnated with a cellulose cross-linking reagent selected from the group consisting of:
      a. reaction products of formaldehyde with carboxamides wherein said reaction products contain 2 or 3 N-methylol groups and methyl esters thereof;
      b. compounds having the following generic formula:

$$R_1OCH_2CH_2SO_2(QSO_2)_nCH_2CH_2OR_2$$

wherein $R_1$ and $R_2$ may be the same or different and are selected from the group consisting of hydrogen and an alkyl radical of up to five carbon atoms; Q is a divalent organic radical selected from the group consisting of aliphatic radicals containing at least three carbon atoms, aromatic radicals and alkylaromatic radicals; and, *n* is 0 or 1; and, said reaction conditions include the presence of an alkaline catalyst;
      c. compounds selected from the group consisting of 1,3,5 tris (hydroxypropyl) hexahydro-s-triazine and 1,3,5 tris (methoxypropyl) hexahydro-s-triazine; and
      d. tris-1-aziridinyl phosphine oxide; and,
   2. heated in an atmosphere in which the relative humidity is less than 100% and in the presence of a catalyst, to a temperature in the range of between about 200° F. to about 1000° F. for a period of time in the range of between about 5 minutes and about 4 seconds during which time period said cross-linking reagent is chemically bonded to said cellulosic material, said time-temperature relationship being such that in the lower temperature range the time period is in the higher time range and in the higher temperature range the time period is in the lower time range and under such heating conditions that the maximum heat energy applied to said impregnated material is that heat energy which allows said material to have a maximum dry crease recovery angle increasable by at least 10% by subsequent heating to cure said material, to thereby produce a modified material intermediate; and, 3. washed to remove the unreacted cross-linking reagent and impregnated with a catalyst suitable for catalyzing the cross-linking of said cellulose cross-linking reagent; and, B. heating the shaped material to cure said chemically bonded cross-linking reagent to provide a permanently shaped textile article having at least said increased dry crease recovery angle.

20. A process of making a resilient, crease-resistant, shape-retentive textile garment from a cellulosic textile fabric which comprises the sequential steps of impregnating said fabric with an aqueous solution of a curable or reactable aminoplast textile crease-proofing material;

heating the impregnated fabric to effect substantially complete removal therefrom of the water originally contained in the unimpregnated fabric as well as the water added to the fabric through impregnation with the aqueous aminoplast crease-proofing material and to effect significant partial reaction or cure but substantially less than the complete reaction or cure achievable in the particular aminoplast-cellulose reaction or cure system under the conventional conditions of cure for said system;

cutting the resulting partially reacted or cured fabric according to the patterns of a garment;

sewing the resulting cut fabric to form a garment;

pressing a shape into said garment; and thereafter heating the partially reacted or cured fabric in said garment to effect more complete reaction or cure in said fabric, with the proviso that no catalytic composition for said particular cellulose-aminoplast reaction or cure system is applied to said fabric subsequent to effecting said partial reaction or cure but prior to effecting said more complete reaction or cure.

* * * * *

UNITED STATES PATENT AND TRADEMARK OFFICE

CERTIFICATE OF CORRECTION

PATENT NO. : 4,032,992

DATED : July 5, 1977

INVENTOR(S) : Ildo Emil Pensa and Robert Otto Rau

It is certified that error appears in the above-identified patent and that said Letters Patent are hereby corrected as shown below:

In the Abstract, line 7, delete the word "groups" and substitute --group--.

In the Table, at the bottom of Column 5, in "Solution C (v)" and under the heading "DRY Crease Recovery - After Catalyst Treatment and Curing" delete "245°" and substitute --266°--.

Column 6, line 46, delete "0.5%" and substitute --0.05%--.

Column 10, line 53, delete "conveniently" and substitute --commercially--.

Column 13, line 21, delete "fabric" and substitute --fabrics--.

In the Table at the bottom of Column 13, change "Soluton A" to --Solution A--.

UNITED STATES PATENT AND TRADEMARK OFFICE

CERTIFICATE OF CORRECTION

PATENT NO. : 4,032,992

DATED : July 5, 1977

INVENTOR(S) : Ildo Emil Pensa and Robert Otto Rau

It is certified that error appears in the above-identified patent and that said Letters Patent are hereby corrected as shown below:

In the Table at the bottom of Column 13, under the heading "Original Crease Recovery Angles (ii) After Catalyst Treatment and Curing - DRY" and in the column entitled "Radiant Heat - Solution A" delete "262°264°" and substitute --262°--.

In the same Table as above under the same heading, in the column entitled "Radiant Heat - Solution B" delete "-", and substitute --264°--.

In the same Table at the bottom of Column 13, under the same heading, in the column entitled "Curing 120 SEC./325°F - Solution A" add -- - --.

In the same Table at the bottom of Column 13, under the same heading, in the column entitled "Curing 120 SEC./325°F - Solution B" add -- - --.

Column 15, line 25, delete "3%" and substitute --30%--.

UNITED STATES PATENT AND TRADEMARK OFFICE

CERTIFICATE OF CORRECTION

PATENT NO. : 4,032,992

DATED : July 5, 1977

INVENTOR(S) : Ildo Emil Pensa and Robert Otto Rau

It is certified that error appears in the above-identified patent and that said Letters Patent are hereby corrected as shown below:

Column 16, line 13, delete "100" and substitute --1000--.

Column 16, line 32, delete "3%" and substitute --30%--.

Column 18, Table at the bottom of the page, line 52, after "(W + F)", add the word -- Dry --.

Column 18, Table at the bottom of the page, line 54, delete the word "Druying" and substitute --Drying--.

Column 18, Table at the bottom of the page, line 58, after the words, "after 10 Launderings &", delete the words "Good to".

Column 18, line 58, under the heading "After Pleating and Curing", before the word "Excellent", add --Good to --.

In Column 18, Table at the bottom of the page, line 59, delete the word "heting" and substitute --heating--.

UNITED STATES PATENT AND TRADEMARK OFFICE

CERTIFICATE OF CORRECTION

PATENT NO. : 4,032,992

DATED : July 5, 1977

INVENTOR(S) : Ildo Emil Pensa and Robert Otto Rau

It is certified that error appears in the above-identified patent and that said Letters Patent are hereby corrected as shown below:

Column 18, last line delete the words "Good to".

Column 19, line 1, before the word "Excellent", Add the words --Good to--.

Column 22, claim 1, line 7, before the word "compounds" insert --b.--.

Column 24, claim 17, line 12 delete "timetemperature" and substitute --time-temperature--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*